United States Patent [19]

Hess

[11] 4,003,521

[45] Jan. 18, 1977

[54] DUAL-PHASE MEAT GRINDER ADAPTER

[75] Inventor: Charles W. Hess, Schiller Park, Ill.

[73] Assignee: Speco, Inc., Schiller Park, Ill.

[22] Filed: May 27, 1975

[21] Appl. No.: 581,275

[52] U.S. Cl. ..... 241/82.4

[51] Int. Cl.[2] ..... B02C 18/30

[58] Field of Search ..... 241/82.1, 82.2, 82.4, 241/82.5; 285/34, 90, 91, 92, 391

[56] References Cited

UNITED STATES PATENTS

| | | | |
|---|---|---|---|
| 348,132 | 8/1886 | Leopold | 241/82.4 |
| 865,095 | 9/1907 | Forrest | 241/82.4 |
| 930,920 | 8/1909 | Bartz | 241/82.4 |
| 959,258 | 5/1910 | Purves | 285/34 |
| 1,668,921 | 5/1928 | Miks | 285/90 |
| 2,075,603 | 3/1937 | Dirr | 241/82.4 |
| 3,542,104 | 11/1970 | Anderson | 241/82.5 |

*Primary Examiner*—Granville Y. Custer, Jr.
*Attorney, Agent, or Firm*—Norman H. Gerlach

[57] ABSTRACT

A dual-phase meat grinder adapter which is capable of threaded reception over the open rear or discharge end of the usual feed channel of the casing of a conventional single-phase meat grinder and which, when so received, affords accommodation for a secondary perforated breaker plate through which relatively large meat segments issuing from the original or primary perforated breaker plate are further broken up into smaller segments. A rotary dual-edge knife between the two breaker plates effects shearing functions in conjunction with both breaker plates during operation of the meat grinder. Peripherally spaced clamping inserts are interposed in the threaded connection between the adapter body and the threaded rim at the discharge end of the feed channel of the grinder casing and function releasably to counteract the torque which is applied to the adapter body under the influence of the rotating knife and meat product within the grinder casing.

3 Claims, 5 Drawing Figures

DUAL-PHASE MEAT GRINDER ADAPTER

The present invention relates generally to meat grinding apparatus and has particular reference to a novel adapter which is designed for use in connection with a conventional single-phase meat grinder and which, by the simple expedient of unscrewing the usual breaker plate-retaining ring at the open rear or discharge end of the feed channel of the casing of a conventional meat grinder and then threading the adapter onto said open discharge end of the grinder casing will extend the usefulness of the grinder by effecting the production or formation of smaller meat segments than are capable of issuing from the grinder when the latter is used as a conventional single-phase grinder.

Heretofore, in certain meat establishments such as meat markets, delicatessens, or even in restaurants, when it is required to produce meat segments of relatively small size, such, for example, as in the preparation of hamburger meat, it is the general practice to prepare the product in two separate operations. Large meat chunks are initially run through a meat grinder which employs a single perforated breaker plate having relatively large perforations therein and, thereafter, the product which issues from such meat grinder is then run through a second and separate meat grinder having a single perforated breaker plate containing smaller perforations than the first used breaker plate. This procedure, of course, necessitates an undue amount of handling of the meat and enhances the chance of contamination of the ground end product. In addition, it requires cleaning and sterilization of the various meat receptacles and also the grinders themselves. Such dual-phase grinding of large meat chunks is, of course, necessary in practically all instances inasmuch as any attempt to utilize a single meat grinder having a breaker plate with small perforations ordinarily will result in clogging of the perforations and binding of the feed worm regardless of whether the latter be manually or electrically powered or operated.

Certain meat grinders now on the market and in use, both commercial and those intended for home or kitchen use, are supplied with interchangeable perforated breaker plates with large and small perforations. Such grinders are, however, highly objectionable because they entail the inconvenience of having to unscrew the retaining ring for the perforated breaker plate with large perforations, substituting therefor the breaker plate with small perforations, and finally replacing the retaining ring. There are also on the market various types of dual-phase meat grinders which are in the nature of unitary and completely preassembled structures and are purchased, and which invariably must be operated as dual-phase structures by reason of the fact that no provision is made for converting them to single-phase meat grinders.

The present invention is designed to overcome the above-noted limitations that are attendant upon the present-day dual-phase meat grinders, especially those for home or kitchen use as well as for use in retail establishments as outlined above, and toward this end the invention contemplates the provision of a novel adapter embodying a terminal or secondary perforated breaker plate which has relatively small perforations therein and is capable of being readily applied to a conventional single-phase grinder with a minimum of effort, and which, when so applied, maintains the secondary breaker plate spaced rearwardly of the original perforated breaker plate so that a dual-edge rotary cutter or knife assembly which cooperates with both breaker plates and is interposed between the two breaker plates will serve to shear the once-treated meat fragments issuing from the primary breaker plate from such plate and introduce them to the perforations in the secondary plate from whence they issue rearwardly in the form of twice-treated small meat fragments.

The provision of a dual-phase meat grinder adapter such as that briefly outlined above and possessing the stated advantages constitutes the principal object of the present invention.

A further feature of the present invention resides in the provision of novel means for assimilating the torque which is applied to the meat grinder adapter due to the tendency of the rotating dual-edge cutter or knife assembly to effect rotation of the adapter bodily in a direction tending to unscrew the same from the casing of the associated meat grinder to which it is applied, such means taking the form of an annular series of clamping inserts which are regularly adjustable radially inwardly of the threaded rim of the discharge end of the feed channel of the grinder casing and, in addition, are circumferentially spaced around the portion of the adapter which is threadedly received over said threaded rim of the feed channel. Whereas the use of ordinary setscrews for tightening the adapter on the casing of the associated meat grinder to prevent rotation of the former ordinarily would damage the interengaging screw threads, the use of such radially shiftable inserts obviates this difficulty.

The provision of a dual-phase meat grinder adapter which is entirely self-contained and may be maintained in its assembled condition so that it requires no sequential assembly of parts during application thereof to a meat grinder for conversion purposes; one which, in such assembled condition, need only to be threaded onto the rear or discharge end of the feed channel of the body of the associated meat grinder and then tightened in place; one which in no way requires modification of the meat grinder to which it is applied so that, after removal of the adapter from the grinder, the latter may be restored to its normal single-phase use; one in which the cutter or knife assembly which is associated therewith derives its motion from the motion of the feed worm which is associated with and forms a part of the meat grinder; one which, when necessary, is capable of ease of assembly and dismantlement for purposes of cleaning, inspection of parts, or repair; and one which is otherwise well-adapted to perform the services required of it, are further desirable features which have been borne in mind in the production and development of the present invention.

Other objects and advantages of the invention not at this time enumerated will become readily apparent as the nature of the invention is better understood from a consideration of the following detailed description.

The invention consists in the several novel features which are hereinafter set forth and are more particularly defined by the claims at the conclusion hereof.

In the accompanying three sheets of drawings forming a part of this specification, one illustrative embodiment of the invention is shown.

Figure 4:
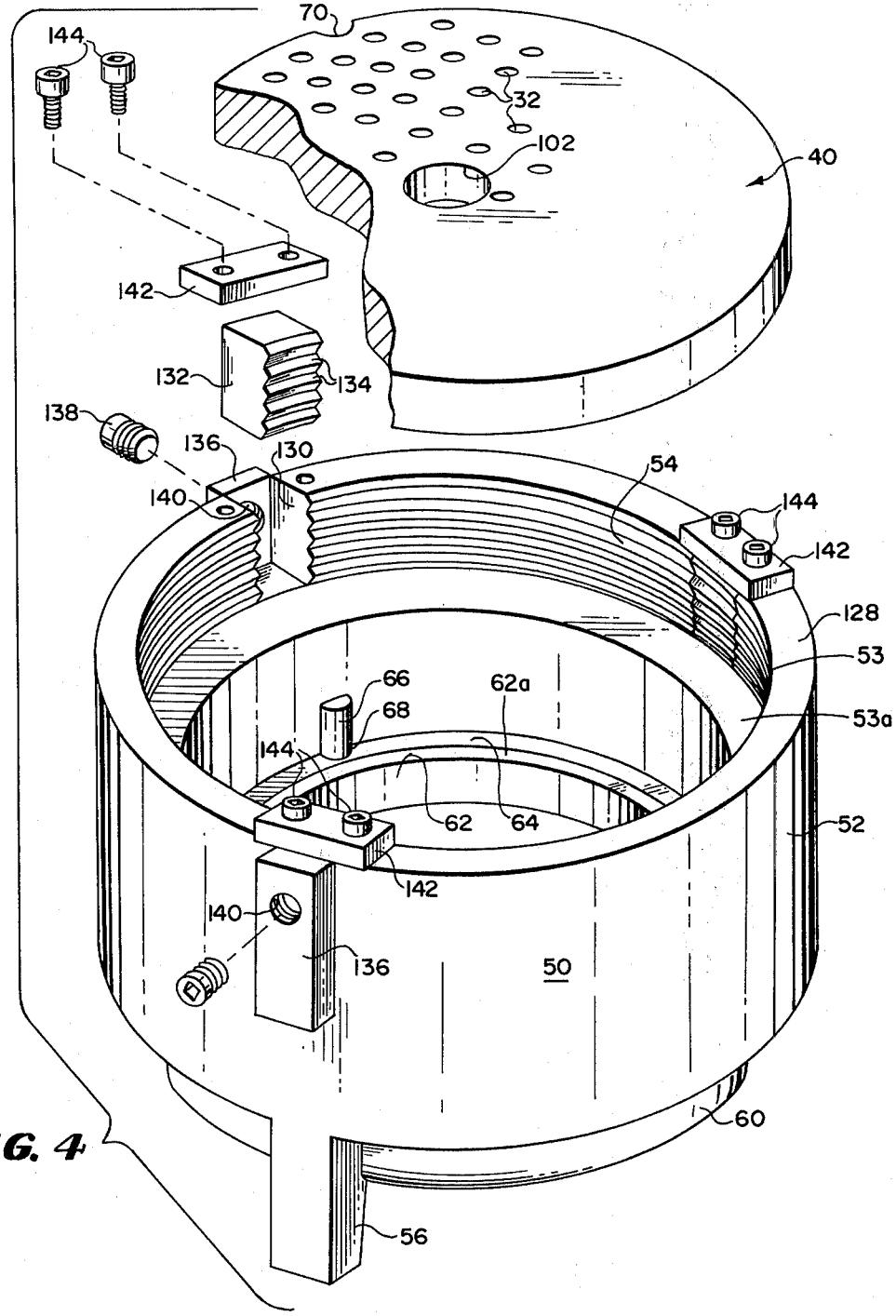
Figure 5:
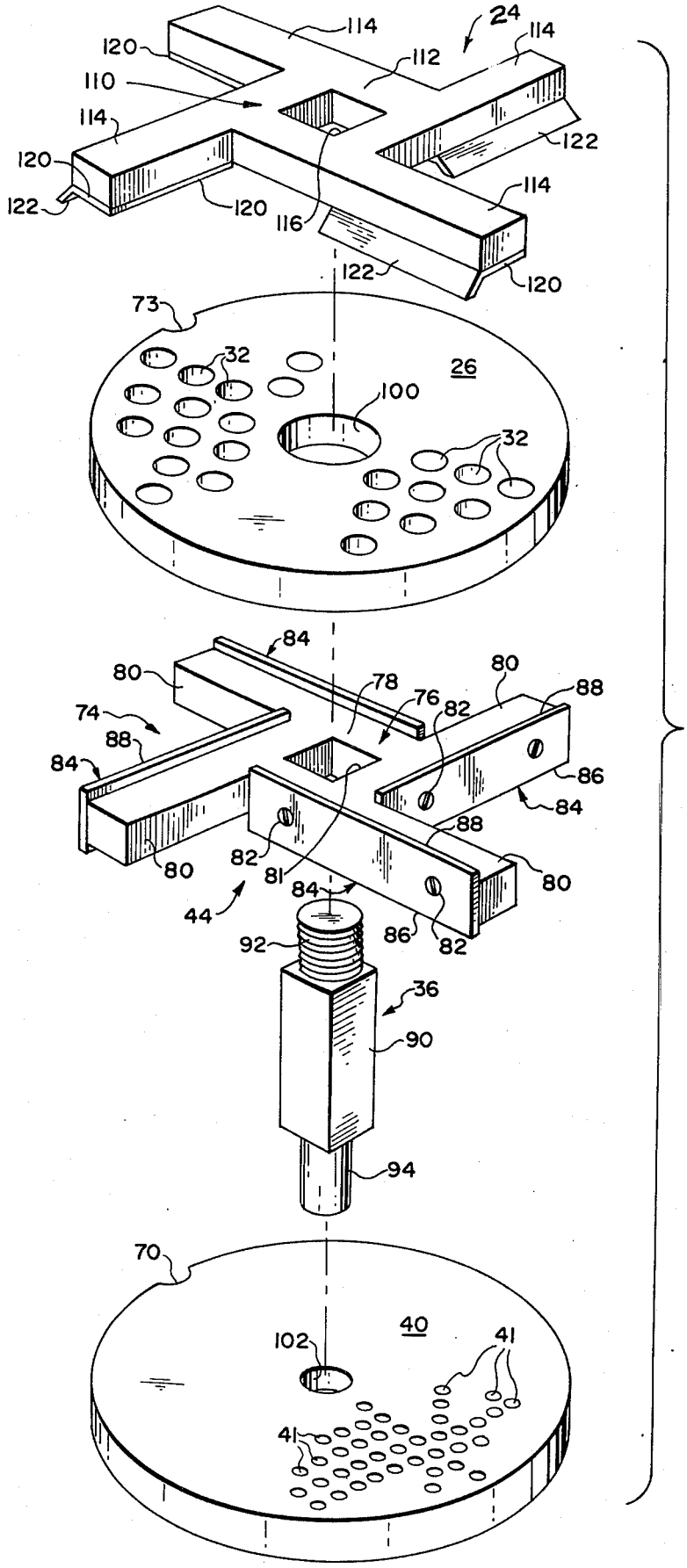

FIG. 4 is an enlarged exploded perspective view, partly in section but mainly in elevation, illustrating the manner in which the adapter body and the perforated secondary breaker plate are assembled, the primary breaker plate and the dual-edge meat-cutting knife being omitted in the interests of clarity; and FIG. 5 is an enlarged exploded perspective view of the dual-edge cutting knife assembly which is employed in connection with the invention.

Figure 1:
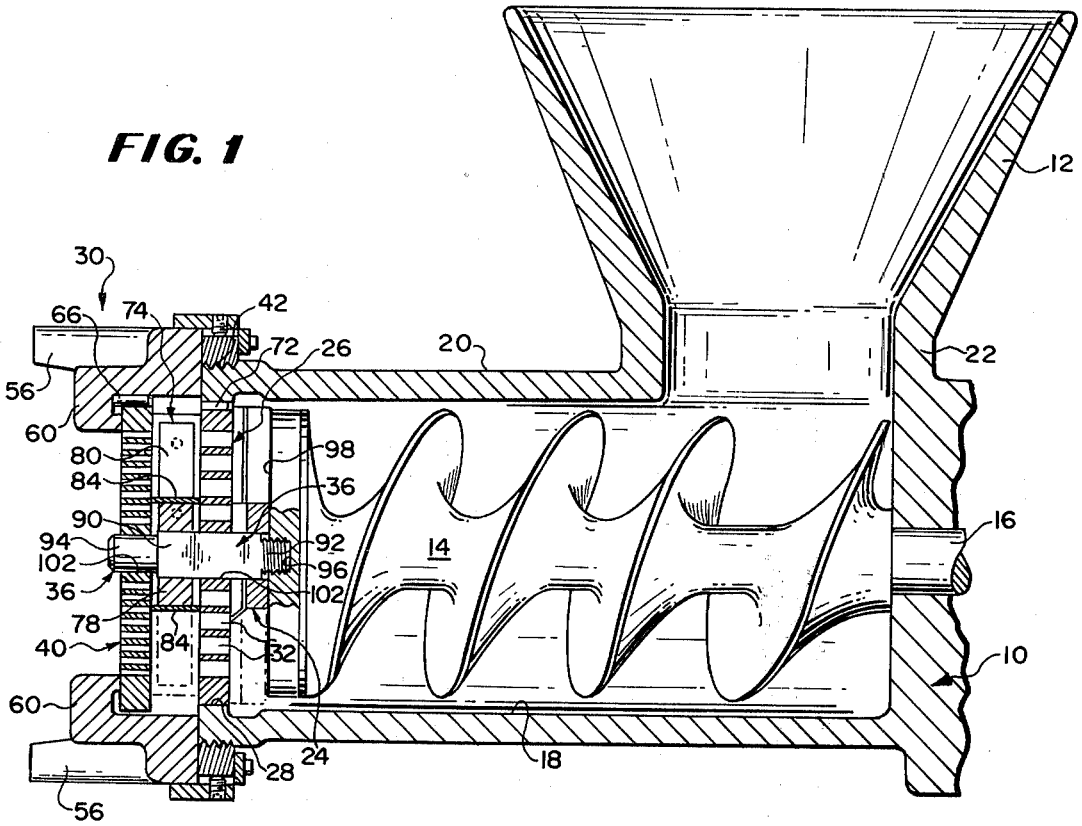
FIG. 1 is a fragmentary sectional view taken substantially centrally and longitudinally through a more or less conventional meat grinder and showing the improved dual-phase adapter of the present invention operatively applied to the open discharge end of the feed channel of the casing thereof.

Referring now to the drawings in detail and in particular to FIG. 1, the casing of a conventional meat grinder is disclosed in this view, together with its enclosed operating instrumentalities including the usual feed worm, rotary cutter and perforated breaker plate. The usual retainer ring which is threadedly received on the open rear discharge end of the casing has been omitted and, in its stead, there has been substituted the two-phase meat grinder adapter constituting the present invention.

More specifically, the illustrated meat grinder, exclusive of the application thereto of the present two-phase adapter, is of the general type which is illustrated and described in U.S. Pat. No. 3,542,104, granted on Nov. 24, 1970 and entitled "MEAT GRINDER WITH PNEUMATICALLY-BIASED RETAINER RING." Such grinder involves in its general organization a horizontally elongated grinder casing 10 which includes at the receiving end thereof the usual upstanding funnel-shaped hopper 12 into which chunks or pieces of meat are placed and then tamped downwardly as a preliminary to horizontal pick-up and feed by a horizontally positioned rotatable feed worm 14. The latter is disposed in and extends longitudinally through the grinder casing 10 and has its front or receiving end fixedly connected to the inner or rear end of a coaxial, rotatable drive shaft 16. The worm 14 is operatively disposed in coaxial relationship within a cylindrical feed channel 18 which is formed in a cylindrical section 20 of the casing 10 and communicates with the hopper 12 through a narrow neck portion 22.

The shaft 16 is adapted to be driven by an electric motor or other power source (not shown), it being understood that mounting facilities for the motor and its driving connection with the drive shaft 16 are conventional and have no relationship to the present invention and, consequently, no illustration thereof has been made herein.

Considering the casing 10 in the absence of the present two-phase adapter, meat chunks or pieces which are forced downwardly into the funnel-shaped hopper 12, and from thence into the feed channel 18 are forced rearwardly past a rotary cutter assembly 24 and against a stationary perforated breaker plate 26 which is normally held in position across the circular opening 28 at the rear or discharge end of the casing 10 by means of the usual retainer ring (not shown). The latter, according to the present invention, is replaced by the aforementioned two-phase meat grinder adapter, the latter being designated in its entirety by the reference numeral 30. The meat pieces or chunks which are forced into the confines of the worm 14 are impelled forcibly forwardly through the feed channel 18 and through a plurality of relatively large diameter extrusion perforations 32 which are provided in the breaker plate 26, such perforations cooperating with the cutter assembly 24 and the latter being carried on a horizontally extending pilot shaft 36 (see FIGS. 1, 2 and 5) at a point or location near the front end thereof. This pilot shaft 36 is suitably secured to the extreme rear end of the worm 14. The cutter assembly 24, in combination with the perforations 32 in the breaker plate 26, effect the shearing of small meat fragments from the bulk meat product within the feed channel 18, and these fragments ordinarily, in the absence of the present adapter 30, pass through perforations in the breaker plate 26 and are received either in a suitable receptacle or on a conveyor which may be positioned under the rear end region of the meat grinder.

The arrangement of parts thus far described is more or less conventional and no claim is made herein to any novelty associated therewith, the present invention residing rather in the nature of the subsequently to-be-described dual-phase meat grinding adapter 30 which, by the simple expedient of unscrewing the conventional retaining ring at the rearward end of the cylindrical section 20 of the grinder casing 10 and threading the adapter 30 in its place, will convert the single-phase meat grinder into a dual-phase grinder in which the perforated breaker plate 26 constitutes a primary breaker plate and in which a secondary breaker plate 40 having relatively small extrusion perforations 41 also is employed, all in a manner that will be set forth in detail presently.

Figure 2:
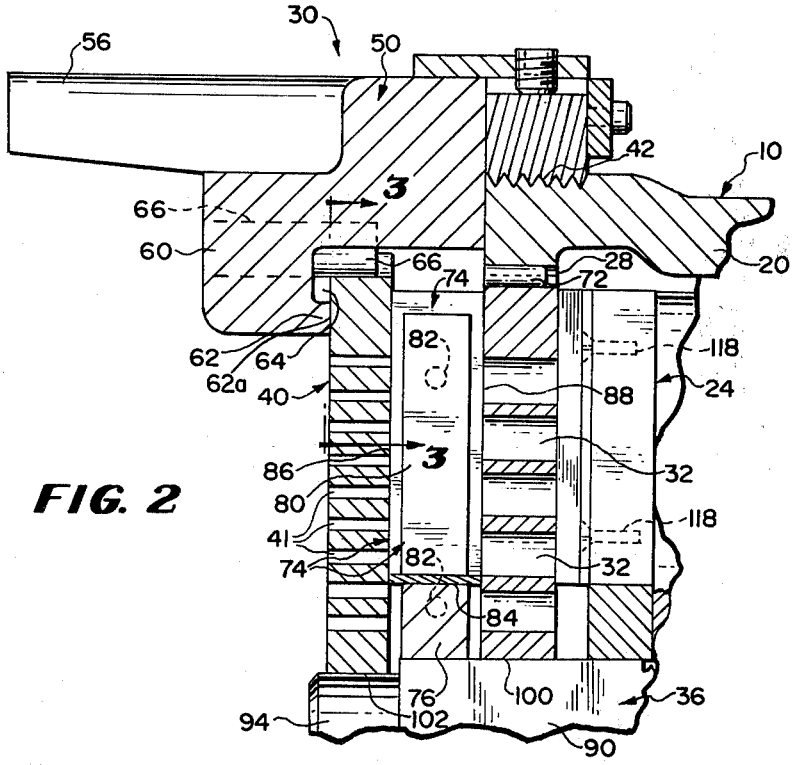
FIG. 2 is an enlarged sectional view of a limited portion of the structure of FIG. 1, the view being taken in the vicinity of the improved dual-phase grinder adapter.

Still referring to FIGS. 1 and 2 of the drawings, the extreme rear rim region of the cylindrical section 20 of the grinder casing 10 is provided with an exterior screw thread 42, such screw thread normally receiving the aforementioned conventional retaining ring which holds the single perforated breaker plate 26 in position within the circular opening 28. However, with the retaining ring omitted and the adapter assembly 30 substituted therefor as previously set forth, this screw thread 42 functions as the sole means for retaining the adapter 30 as a whole in position on the grinder casing 10.

Figure 3:
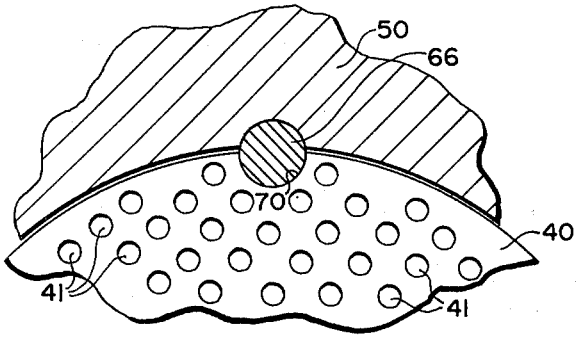
FIG. 3 is a fragmentary sectional view on the line 3—3 of FIG. 2.

The dual-phase adapter 30 of the present invention involves in its general organization an open-ended, ring-shaped, one-piece adapter body 50 (see FIG. 3) which is of generally cylindrical configuration and includes a cylindrical wall 52, the front or inner end region of which has formed therein a coaxial counterbore which defines a cylindrical internal side surface 53 and a flat inwardly extending annular shoulder **53*a*. The cylindrical internal side surface 53 is provided with an interrupted internal screw thread 54, the latter being designed for telescopic or threaded reception over the external screw thread 42 on the rear end of the cylindrical section 20 of the grinder casing 10. The rear end region of the adapter body 50 is formed with a series of three or more leg-like protrusions 56, such protrusions bearing no relation to the operation of the adapter 30 but serving merely as a support for the adapter as shown in FIG. 4 when the adapter is detached from the grinder body 10** and placed upright upon a bench or other support for purposes of initial adapter assembly or for purposes of inspection of parts or repair.

The one-piece adapter body 50 is provided on its rear end region with an integral inturned flange-like forward seating rim 60 which embodies on its inner peripheral portion an integral forwardly extending annular boss 62 the forward surface 62*a* of which is flat and annular and is adapted to have the peripheral portion of the secondary breaker plate 40 seat directly against it. The boss 62, in combination with the cylindrical wall 52 of the adapter body 50, defines a shallow annular trough or groove 64. The peripheral region of the aforementioned secondary breaker plate 40 seats directly upon said forwardly facing flat and annular surface of the reentrant boss 62 as heretofore mentioned and as clearly shown in FIG. 2, overhangs the aforementioned boss, and extends to a region in close proximity to the inner periphery of the cylindrical wall 52 of the adapter body 50. By reason of the one-piece character of the adapter body 50 the flat and annular forwardly facing surface 62*a* is at all times spaced a fixed distance from the annular shoulder 53*a* and this is of importance insofar as it results in the dual-phase adapter 30 as a whole maintaining extremely high cutting efficiency. A horizontally extending cylindrical, pin-like plug or key 66 (see FIG. 2) projects through a cylindrical socket 68 in the inturned rim 60, projects into the annular trough or groove 64, and cooperates with a notch-like recess or keyway 70 (see FIGS. 3 and 5) in the periphery of the secondary breaker plate 40 to prevent rotation of the latter relatively to the grinder casing as will be made clear presently. The annular groove 64 is adapted in connection with operation of the grinder to have meat fragments seep into it and the seepage within the groove develops against the rear face of the secondary breaker plate a pressure which is counter to that against the front face of said secondary breaker plate thereby maintaining in effect equilibrium of the secondary breaker plate 40 as a whole and materially facilitating removal of the secondary breaker plate from the adapter body 50 after removal of the latter from the rear rim region of the grinder casing 10.

The primary perforated breaker plate 26 fits snugly within the open rear rim region of the feed channel 18 and may be held against turning movement therein by means of a horizontally extending, cylindrical, pin-like key 72 (see FIG. 2) which is similar to the key 66 and cooperates with a recess or keyway 73 in the periphery of the breaker plate 26.

Interposed between the primary perforated breaker plate 26 and the secondary perforated breaker plate 40 is a dual-edge cutter assembly 74 (see FIGS. 1, 2 and 5), the latter consisting of a generally swastika-shaped cutter body 76 embodying a central hub portion 78 and four outwardly projecting arms 80, the latter being arranged in quadrilateral fashion. A square hole 81 is formed in the hub portion 78 of the body 76 and this is adapted to receive the a particular region of the pilot shaft 36 in a manner and for a purpose that will be made clear presently. Secured by fastening screws 82 (see FIG. 2) to the trailing sides of the four outwardly projecting arms 80 of the cutter body 76 is a series of four rectangular knife blades 84, these blades being formed of flat steel spring stock having rear and front knife edges 86 and 88. The rear knife edges 86 of the blades 84 are in direct shearing contact with the front face of the secondary breaker plate 40 and the front knife edges 86 are in direct shearing engagement with the rear face of the primary breaker plate 26. The blades 84 span the distance between and serve positively to maintain at all times in fixed spaced apart relation the two perforated breaker plates 40 and 26, the knife edges 88 cooperating with the extrusion perforations 32 in the primary perforated breaker plate 26 and the knife edges 86 cooperating with the extrusion perforations 41 in the secondary perforated breaker or grinder plate 40. The dual-edge cutter assembly 74 thus operates between the two grinder or breaker plates 26 and 40.

As best shown in FIGS. 1 and 5 of the drawings, the aforementioned horizontally extending pilot shaft 36 embodies a medial enlarged knife-impelling section 90 which is square in cross section, an externally threaded cylindrical front end section 92, and a reduced diameter pilot section 94. The externally threaded front end section 92 is threadedly received in an internally threaded socket 96 (see FIG. 1) in the rear end surface 98 of the feed worm 14, and thus, the pilot shaft 36 assumes a fixed or driven relationship with respect to the feed worm 14 and projects rearwardly therefrom. The internally threaded socket 96 is conventionally formed in the rear end surface of the worm 14 and normally receives therein a relatively short pilot shaft which is similar to the pilot shaft 36 but is adapted to be removed when the dual-phase adapter 30 is applied to the grinder casing 10. The aforementioned primary perforated breaker plate 26 is formed with a relatively large circular hole 100 in the central portion thereof, the diameter of such hole being slightly larger than the diagonal extent of the square enlarged medial section 90 of the pilot shaft 36. The latter projects through such hole 100 and is thus freely rotatable therein. The square medial section 90 of the pilot shaft 36 projects through and fits snugly within the square hole 81 in the hub portion 78 of the body 76 of the dual-cutter assembly 74 in order that said dual-edge knife assembly 74 is rotatable bodily as a unit with the feed worm 14 and consequently with the pilot shaft 36.

The secondary perforated breaker plate 40 has formed therein a relatively small diameter centrally located circular pilot hole 102 (see FIGS. 1, 2 and 5) into which the pilot section 94 of the pilot shaft 36 projects and within which it is effectively piloted.

With the adapter 30 in position on the meat grinder casing 10 in the manner previously described, the aforementioned cutter assembly 24 constitutes, in effect, a primary cutter assembly while the dual-phase cutter assembly 74 constitutes a secondary cutter assembly.

The primary cutter assembly 24 is best illustrated in FIG. 5 and is in the form of a unitary generally swastika-shaped cutter body 110, which is similar to the cutter body 76 of the dual-cutter assembly 74 and has a central hub portion 112 and four outwardly projecting arms 114. A square hole 116 is formed in the hub portion 112 and this is adapted to receive the front region of the square section 90 of the pilot shaft 36 as best shown in FIG. 1 of the drawings. Secured to the rear side faces of the four outwardly projecting arms 114 by means of fastening screws 118 (see FIG. 2) is a series of four angular shearing knife blades 120 having forwardly turned leading edge portions 122, the latter being designed for sweeping and shearing engagement with the large extrusion perforations 32 in the primary breaker plate 26. Since the hubs 112 and 78 of the primary and secondary breaker plates 26 and 40 are each provided therein with square openings which fit snugly over the square medial section 90 of the pilot shaft 36, it is obvious that both cutter assemblies 24 and 74 will rotate in unison during rotational movement of the feed worm 14 and its associated pilot shaft 36.

It will be appreciated that upon rotation of the worm and cutter assemblies 24 and 74, considerable torque will be imposed upon the perforated breaker plate 40 tending to rotate the entire adapter assembly 30 in a direction which will cause unthreading of the same from the rear rim of the cylindrical section 20 of the grinder casing 10. Additionally, the meat which is undergoing grinding and is more or less firmly compacted within the space which exists within the adapter 30 and between the two breaker perforated plates 26 and 40 will tend to rotate bodily under the influence of the dual-edge cutter assembly 74, thus applying further torque to the adapter assembly 30 as a whole. Accordingly, and in order to inhibit unthreading of the adapter assembly from the grinder body 10, and as best illustrated in FIG. 4 of the drawings, the front end surface 128 of the cylindrical wall 52 of the adapter body 50 is formed with a series of three relatively deep cut-outs or notch-like recesses 130, the depth of which is substantially equal to the transverse extent of the internal screw thread 54 within the front portion of the cylindrical wall 52 of the adapter body 50. Fitted within each of these notches 130 is a clamping insert 132 which is of block-like design and has internal screw thread fragments 134. The latter, when the inserts 132 are in place within their respective recesses 130, constitute extensions of the interrupted internal screw threads 54 within the front portion of the cylindrical wall 52 of the adapter body 50. Three block-like reaction members or plates 136 are welded or otherwise fixedly secured to the outer surface of the cylindrical wall 52 of the adapter body 50, serves to close the outer side portions of the recesses 130, and have their front end surfaces of the adapter body 50 terminating flush with the front end surface 128 of the side wall 52.

The clamping inserts 132 are capable of limited radial sliding movement within their respective recesses 130 and are capable of being urged radially inwardly in centripetal fashion by means of radially extending clamping screws 138 which extend through internally threaded holes 140 in the reaction members or plates 136 and have their inner ends in abutment with the outer surfaces of the clamping inserts 132. Retainer or hold-down plates 142 overlie the open front ends of the recesses 130 and are fastened in position by means of horizontally extending anchoring screws 144 which extend through the end regions of the hold-down plates and extend into threaded holes in the front rim region of the cylindrical wall 52 of the adapter body 50.

In the operation of the herein described dual-phase meat grinder adapter 30, assuming that the same is to be operatively installed upon a conventional meat grinder casing such as the illustrated casing 10, after the usual retaining ring at the rear end of the feed channel 18 in the grinder casing has been unthreaded and removed from the casing, and the pilot shaft 36 substituted for the original pilot shaft, the generally cylindrical body 50 of the adapter is threaded onto the external screw thread on the rear end region of the cylindrical section 20 of the grinding casing 10 as shown in FIGS. 1 and 2, and thereafter the clamping screws 138 are tightened so as to displace the threaded block-like inserts 132 radially inwardly against the interrupted external screw thread 42, and thus, securely clamp the adapter 30 in position on the meat grinder casing 10. The thus converted meat grinder is ready for immediate operation.

The meat chunks which are forced into the funnel-shaped hopper 12 are conducted forwardly through the feed channel 18 under the influence of the feed worm 14 in the usual manner of meat grinder operation so that considerable pressure is built up within the meat product at the rear end of the feed channel. The rotary primary cutter assembly 24 then cooperates with the large extrusion perforations 32 in the primary breaker plate 26 so that reduced size fragments of meat are forced rearwardly through these perforations and into the space which exists between the primary perforated breaker plate 26 and the secondary perforated breaker plate 40. Since considerable pressure is built up within this space, the rotating dual-edge cutter assembly 74 effects a rotary motion of the meat product between the two plates, the front edges 88 of the knife blades 84 cooperating with the rear side of the primary breaker plate 26 to sever meat fragments from the extrusion perforations 32 and the rear edges 86 cooperating with the front side of the secondary perforated breaker plate 40 to force meat fragments through the small extrusion perforations 41 in the last-mentioned breaker plate. The small size fragments issuing from the rear side of the secondary perforated breaker plate 40 may then fall by gravity into a suitable receptacle or they may be deposited on a suitable transport conveyor or the like. It is to be noted at this point that during the operation of the herein described dual-phase meat grinder adapter 30, the key 66 serves to prevent rotation of the secondary breaker plate 40, while similarly the key 72 prevents rotation of the primary breaker plate 26. After use of the herein-described meat grinder, the ring-shaped, one-piece adapter body 50 may be removed as a unit from the rear rim region of the grinder casing 10 by an unscrewing action, and upon its removal from the grinder casing the two breaker plates and the secondary cutter assembly are exposed in such a manner that they may be readily removed for cleaning or other purposes.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claims is the same to be limited.

I claim:

1. The combination with a meat grinder of the type which includes an elongated generally cylindrical grinder casing defining therein for the rearward passage of meat pieces to be ground a longitudinally extending cylindrical feed channel of uniform diameter from end to end and with its rear end open, and having on its rear rim portion an external screw thread, and also includes a rotary meat-impelling worm extending lengthwise through the feed channel, of a dual-phase adapter secured removably to said rear rim portion of the grinder casing and comprising a generally ring-shaped, one-piece adapter body positioned normally adjacent to and in coaxial relation with the rear end of the feed channel and having in its front end region a coaxial counterbore defining a cylindrical internal side surface and a flat inwardly extending annular shoulder, said side surface having an internal screw thread normally threadedly received over said external screw thread on the rear rim portion of the grinder casing, and said flat inwardly extending annular shoulder normally being in direct contact with the end face of said rear rim portion of the grinder casing, said ring-shaped, one-piece adapter body having on its rear end region an internal, flange-like, inturned seating rim the inner surface of which is flat and annular and is at all times spaced a fixed distance from said annular shoulder due to the one-piece character of the adapter body, a pilot shaft normally positioned in coaxial relation at the rear end region of the grinder casing, having its front end connected fixedly to the rear end of the worm, and comprising a non-circular cutter-impelling inner section and a reduced cylindrical outer pilot section, a fixed primary perforated breaker plate fitting slidably within and extending across said rear rim region of the grinder casing and embodying in its central portion a circular hole through which the cutter-impelling inner section of the pilot shaft extends loosely and rotatably, a fixed secondary perforated breaker plate fitting slidably within and extending across the central region of the adapter body, spaced rearwards from the primary breaker plate, having its peripheral portion seated directly against the inner surface of said inturned seating flange, and having in the central portion thereof a circular pilot hole in which said outer pilot section of the pilot shaft is journalled, a primary cutter assembly positioned within said rear rim region of the grinder casing, fitting directly against the front surface of the primary breaker plate, and having in the central portion thereof a non-circular opening through which the cutter-impelling section of the pilot shaft extends driveably, a dual edge secondary cutter assembly interposed between the two breaker plates and having a central non-circular opening through which said cutter-impelling inner section of the pilot shaft extends driveably, said secondary cutter assembly having a front knife edge in direct shearing contact with the rear face of the primary breaker plate and a rear knife edge in direct shearing relation with the front face of the secondary breaker plate and serving when in its operative position to maintain the two breaker plates at all times in fixed spaced apart relation, said front end region of the body being provided with a series of circumferentially spaced notch-like recesses which interrupt said internal screw thread and have open outer and inner sides, clamping inserts slidably mounted in said recesses and having internal screw thread segments which, in effect, constitute continuations of said internal screw thread in the front end region of the body, reaction plates secured fixedly to the outer periphery of the adapter body, projecting across the outer sides of said notch-like recesses, and having internally threaded holes extending through their central portions, and clamping screws extending through and threadedly received in said internally threaded holes in said reaction members, having their inner ends in abutment with the outer portions of the clamping inserts, and adapted when tightened to force said clamping inserts radially inwardly within the body in order slightly laterally to misalign their internal screw thread segments and the interrupted internal screw thread on the body and thus increase the mating pressure between said internal screw thread segments and the internal interrupted screw thread to such an extent as to cause the body to be firmly secured against rotation relatively to the grinder casing, said ring-shaped, one-piece adapter body having but the one aforementioned screw thread and being adapted when removed as a unit from the rear rim region of the grinder casing by a single unscrewing action after prior unscrewing of the aforesaid clamping screws to expose the two breaker plates and said secondary cutter assembly for removal purposes.

2. The combination of claim 1 and including, additionally, hold-down retainer plates which are fixedly secured to the inner end edge of the adapter body, extend across the open ends of the notch-like recesses, and serve to capture the slidable inserts within said recesses.

3. The combination with a meat grinder of the type which includes an elongated generally cylindrical grinder casing defining therein for the rearward passage of meat pieces to be ground a longitudinally extending cylindrical feed channel of uniform diameter from end to end and with its rear end open, and having on its rear rim portion an external screw thread, and also includes a rotary meat-impelling worm extending lengthwise through the feed channel, of a dual-phase adapter secured removably to said rear rim portion of the grinder casing and comprising a generally ring-shaped, one-piece adapter body positioned normally adjacent to and in coaxial relation with the rear end of the feed channel and having in its front end region a coaxial counterbore defining a cylindrical internal side surface and a flat inwardly extending annular shoulder, said side surface having an internal screw thread normally threadedly received over said external screw thread on the rear rim portion of the grinder casing, and said flat inwardly extending annular shoulder normally being in direct contact with the end face of said rear rim portion of the grinder casing, said ring-shaped, one-piece adapter body having on its rear end region an internal, flange-like, inturned seating rim the inner surface of which is flat and annular and is at all times spaced a fixed distance from said annular shoulder due to the one-piece character of the adapter body, a pilot shaft normally positioned in coaxial relation at the rear end region of the grinder casing, having its front end connected fixedly to the rear end of the worm, and comprising a non-circular cutter-impelling inner section and a reduced cylindrical outer pilot section, a fixed primary perforated breaker plate fitting slidably within and extending across said rear rim region of the grinder casing and embodying in its central portion a circular hole through which the cutter-impelling inner section of the pilot shaft extends loosely and rotatably, a fixed secondary perforated breaker plate fitting slidably within and extending across the central region of the adapter body, spaced rearwards from the primary breaker plate, having its peripheral portion seated directly against the inner surface of said inturned seating flange, and having in the central portion thereof a circular pilot hole in which said outer pilot section of the pilot shaft is journalled, a primary cutter assembly positioned within said rear rim region of the grinder casing, fitting directly against the front surface of the primary breaker plate, and having in the central portion thereof a non-circular opening through which the cutter-impelling section of the pilot shaft extends driveably, and a dual edge secondary cutter assembly interposed between the two breaker plates and having a central non-circular opening through which said cutter-impelling inner section of the pilot shaft extends driveably, said secondary cutter assembly having a front knife edge in direct shearing contact with the rear face of the primary breaker plate and a rear knife edge in direct shearing relation with the front face of the secondary breaker plate and serving when in its operative position to maintain the two breaker plates at all times in fixed spaced apart relation, the inner peripheral portion of the integral inturned seating rim of the adapter body being provided with an integral forwardly extending annular boss which forms said flat annular surface against which the peripheral portion of the secondary breaker plate seats directly, and, in addition, defines between its outer periphery and the opposed inner peripheral portion of the intermediate region of the central region of the adapter body a shallow annular groove which faces and is disposed adjacent to the outer peripheral portion of said secondary breaker plate and is adapted to have meat fragments seep into it and build up against the rear face of the secondary breaker plate a pressure opposite to that which builds up against the front face of said secondary breaker plate during operation of the meat grinder, said ring-shaped one-piece adapter body having but the one aforementioned screw thread and being adapted when removed as a unit from the rear rim portion of the grinder casing by a single unscrewing action to expose the two breaker plates and said secondary cutter assembly for removal purposes.

* * * * *